US006145462A

United States Patent [19]

Aquino

[11] Patent Number: 6,145,462

[45] Date of Patent: Nov. 14, 2000

[54] TOWABLE DIVER AID

[76] Inventor: Joe Aquino, 2443 Ranch House Rd., West Palm Beach, Fla. 33406

[21] Appl. No.: 09/329,830

[22] Filed: Jun. 10, 1999

[51] Int. Cl.[7] ..... B63B 21/04

[52] U.S. Cl. ..... 114/253; 114/315; 441/68

[58] Field of Search ..... 441/65, 68, 69, 441/72, 73, 75, 79; 114/253, 315

[56] References Cited

U.S. PATENT DOCUMENTS

| | | | |
|---|---|---|---|
| 3,123,844 | 3/1964 | Bailey | 441/72 |
| 4,678,445 | 7/1987 | Monreal | 441/72 |
| 5,178,090 | 1/1993 | Carter | 114/315 |
| 5,605,111 | 2/1997 | Culpepper . | |
| 5,655,939 | 8/1997 | Salvadores . | |

*Primary Examiner*—Stephen Avila
*Attorney, Agent, or Firm*—McHale & Slavin

[57] ABSTRACT

A divers transportation assistance device includes a support platform pivotally mounted within a rigid linking frame. An included tow rope attachment assembly allows the device to be linked to a tow rope and pulled behind a tow boat. A rider positioning construction maintains a rider in a preferred location on the support platform without relying on the arm or hand strength of the rider. Movable articulation posts provide leverage and allow a rider to cause the device to controllably ascend or submerge. The device includes guide fins that help the device maintain a course selected by a rider, and a biasing means urges the device to adopt a surface-skimming orientation, thereby preventing unintentional submerging of the device.

17 Claims, 4 Drawing Sheets

TOWABLE DIVER AID

FIELD OF THE INVENTION

This invention is directed to diver aids and, in particular, to a steerable device towable behind a watercraft for aquatic exploration.

BACKGROUND OF THE INVENTION

People enjoy spending time around the water in a variety of ways. Many people swim about and dive to explore the undersea world. Other people spend time on the water's surface, fishing and traveling about in boats and personal watercraft of all shapes and sizes. Still others enjoy activities that combine elements of boating and diver. Several devices have been developed that allow people to pursue these hybrid activities. Many of these devices are designed to be towed behind a boat, thereby allowing a rider to explore a body of water "firsthand," while traveling at an increased rate of speed, over an extended distance.

U.S. Pat. No. 5,558,551 discloses a steerable swimmer towing device that includes a line anchor for attachment to a tow line extending behind a boat. The device is essentially a planar member having handle apertures that allow an individual to engage the device, and a fin extends from the planar member. An individual can manipulate the planar member to steer and dive within the water.

U.S. Pat. No. 5,655,939 discloses a towable board for underwater swimming and for riding on the water surface. The '939 device is planar and includes a pair of wings or panels joined along the central axis of the device. The front of each wing includes a hand-engaging window that allows the device to be gripped by a rider. A rudder-like fin extends from each wing, and a movable bar provides an adjustable connection point to which a tow rope may be attached. The '939 device allows a rider to travel across, and under, water while being towed behind a vehicle.

U.S. Pat. No. 5,605,111 discloses a submersible aquatic sled capable of towing a diver both on the water's surface and below the water's surface. The device includes a tow line attachment for linking to a line pulled by a tow boat. The sled includes handles that allow the device to be steered above and below the water surface by changing the orientation of the plane of the sled. Optional hand shields mounted on the surface of the sled protect the hands of a diver.

Although several towable devices have been developed that allow a swimmer to travel across and below the surface of water, the known devices may be difficult to use for many swimmers. For example, the known devices require that a swimmer have sufficient arm strength sufficient not only to steer the device, but also to maintain a firm grasp of the device while moving. As a result, the known devices are often unusable by children and by many older swimmers, as well.

Even conditioned swimmers may have difficulty controlling the known devices. The known devices essentially provide a towed diving plane behind which a swimmer is pulled. To steer these devices, a rider must attempt to change the orientation of the diving plane with respect to the direction of travel. This is often difficult to accomplish, because the pivot fulcrum is typically the rope attachment point located on the diving plane, itself. As a result, a swimmer must generate large amounts of leverage to overcome the tendency of the device to remain axially aligned with the tow rope. Successful steering of the known device requires large amounts of force, with leverage requirements increasing as tow speed increases. Unfortunately, with these requirements, even strong swimmers find it difficult to control the known devices in a meaningful manner when traveling at increased speeds.

Thus, what is needed is a diver transportation assistance device that includes advantages of the known devices, while addressing the shortcomings they exhibit. The transportation device should support a diver in a prone position, without relying on the diver hand or arm strength. The device should also provide a mechanical advantage that allows a diver to easily produce leverage sufficient to steer the device in a controlled manner at a wide range of speeds. The device should also have pivot fulcrum that is separate from the tow rope attachment point, so that the device will pivot irrespective of tow rope orientation.

SUMMARY OF THE INVENTION

The instant invention is a diver transportation assistance device. The device includes a rigid support platform that is pivotally mounted within a linking frame. The linking frame is, in turn, attached to a tow rope via a tow rope attachment assembly and towed behind a watercraft.

An included rider positioning construction maintains a rider in a desired orientation on the support platform during travel. The positioning construction eliminates the need for a diver to rely on hand or arm strength to use the device. This arrangement allows use of the device for extended periods of time at a variety of speeds.

Articulation posts movably mounted on the linking frame facilitate controlled relative pivoting between the support platform and the linking frame. Adjusting the orientation of the support platform with respect to the linking frame will make the device dive underwater or ascend towards the surface.

The device includes biasing members that urge the support platform into a surface-skimming orientation. The biasing members extend between the support platform and guide fins mounted on the linking frame. The biasing members prevent the device from submerging unintentionally.

Thus, an objective of the instant invention is to provide a diver transportation assistance device that supports a diver without relying on the swimmer's hand or arm strength.

An additional objective of the instant invention is to provide a diver transportation assistance device that provides a mechanical advantage that allows a diver to easily produce leverage sufficient to steer the device in a controlled manner at a wide range of speeds.

Yet another objective of the instant invention is to provide a diver transportation assistance device that separates the pivot fulcrum from the tow rope attachment point, allowing the device to pivot irrespective of tow rope orientation.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Figure 1:
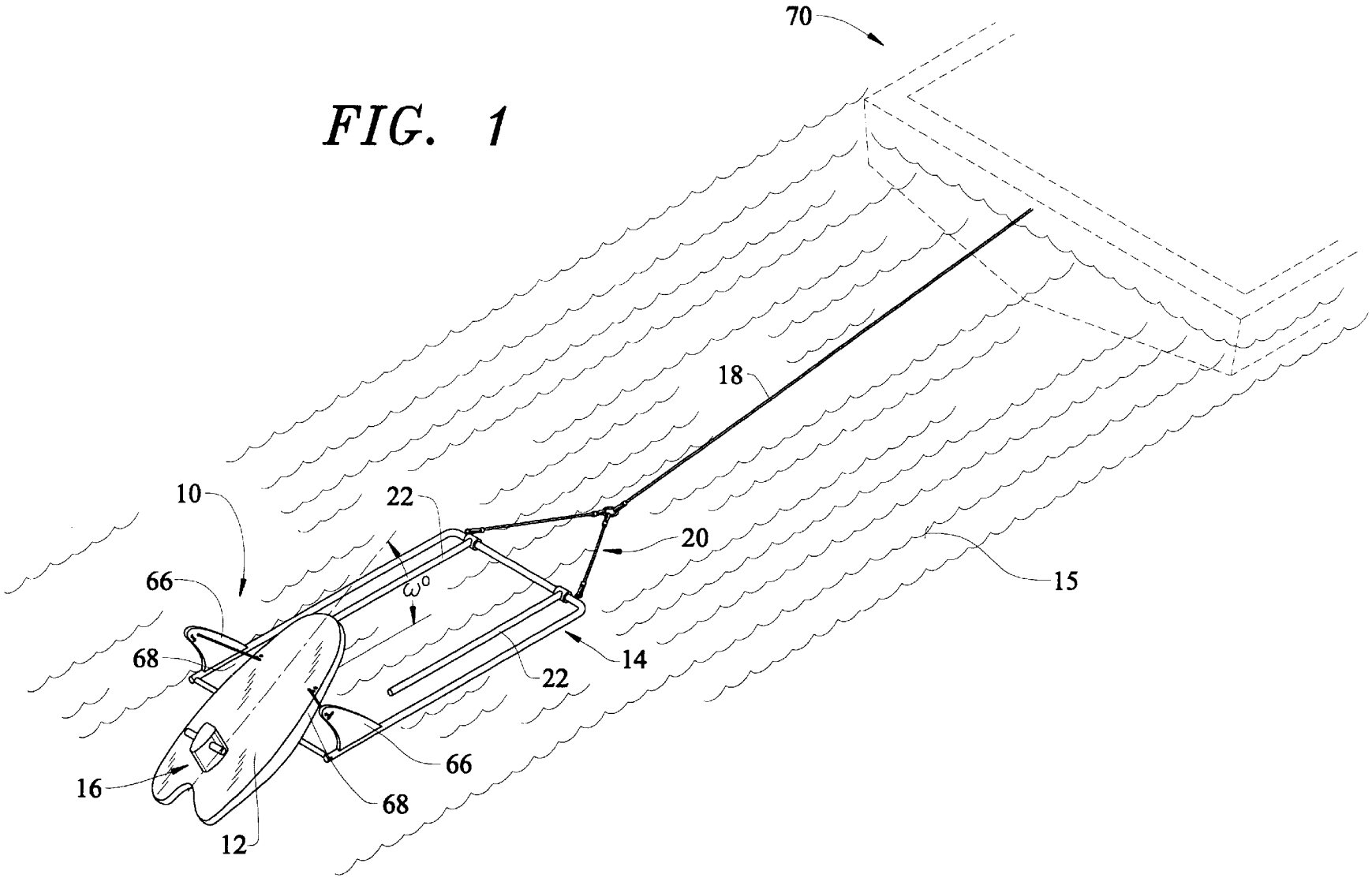
FIG. 1 is a pictorial view of the diver transportation assistance device of the present invention being towed behind boat.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and described in the specification.

Now with reference to FIG. 1, the diver's transportation assistance device 10 of the present invention is shown. By way of overview, the device 10 includes a support platform 12 pivotally mounted within a linking frame 14 and a rider positioning construction 16 which helps orient a rider during use. The linking frame 14 is joined to a tow rope 18 via a tow rope attachment assembly 20, and movable articulation posts 22 extend from the frame to allow a rider to change the relative angle $\alpha$ between the support platform 12 and the frame. The details of the diver transportation assistance device 10 of the present invention will now be discussed.

Figure 2:
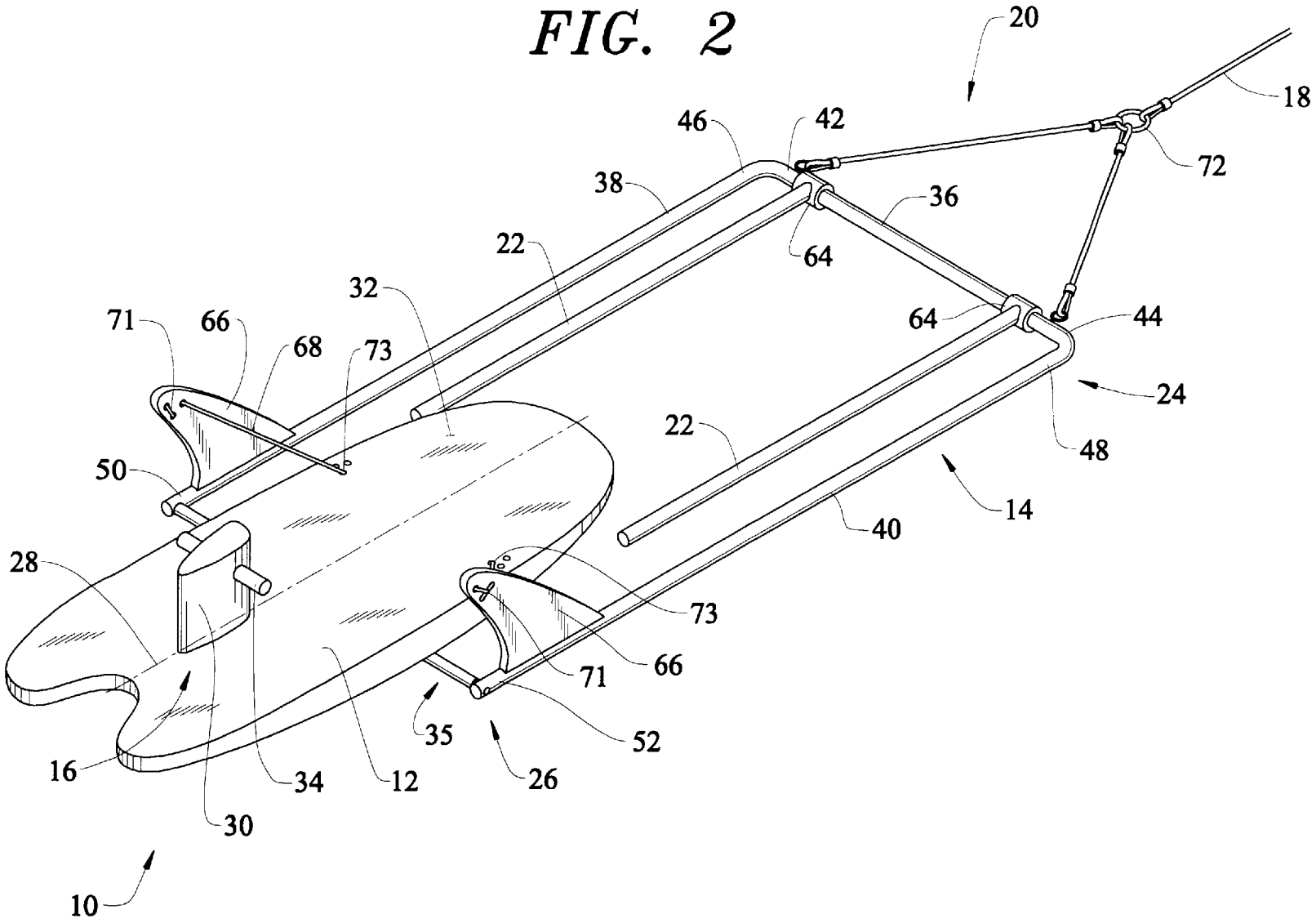
FIG. 2 is an top isometric view of the diver transportation assistance device shown in FIG. 1.

As show in FIG. 2, the support platform 12 is a rigid structure generally resembling a rectangle with contoured front and rear ends 24, 26. In a preferred embodiment, the support platform 12 is symmetrical about the platform central longitudinal axis 28. With continued reference to FIG. 2, the rider positioning construction 16 lies along the center line 28 of the platform 12 and is preferably mounted near the rear end 26 of the platform. It is noted that the location of the rider positioning construction 16 may be modified to accommodate riders of different size. The rider positioning construction 16 includes a spacer plank 30 that extends orthogonally from a rider-facing surface 32 of the support platform 12, and a retention bar 34 that extends transversely through the spacer plank. As mentioned above, the rider positioning construction 16 helps maintain a rider in a desired location on the support platform 12.

Figure 4:
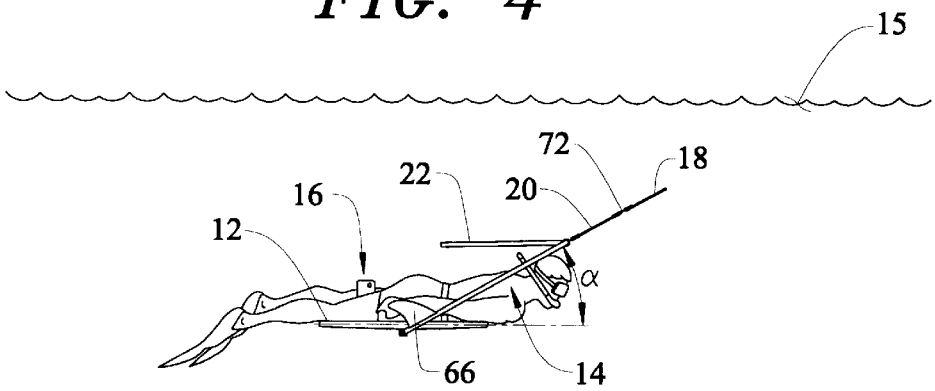
FIG. 4 is a pictorial view of the diver transportation assistance device shown in FIG. 1 in a level travel orientation.

During use, as seen in FIG. 4, a rider lies against the support platform rider-facing surface 32, with both legs extending past the spacer plank 30. The rider's legs are held against the support platform 12 by the retention bar 34, and the rider's chest lies adjacent the platform front end 24. It is noted that the retention bar 34 may be formed integral with the spacer plank 30 or may be a separate, adjustable piece. As will be described more fully below, a mounting axle 35 pivotally joins the support platform 12 and the linking frame 14.

Figure 3:
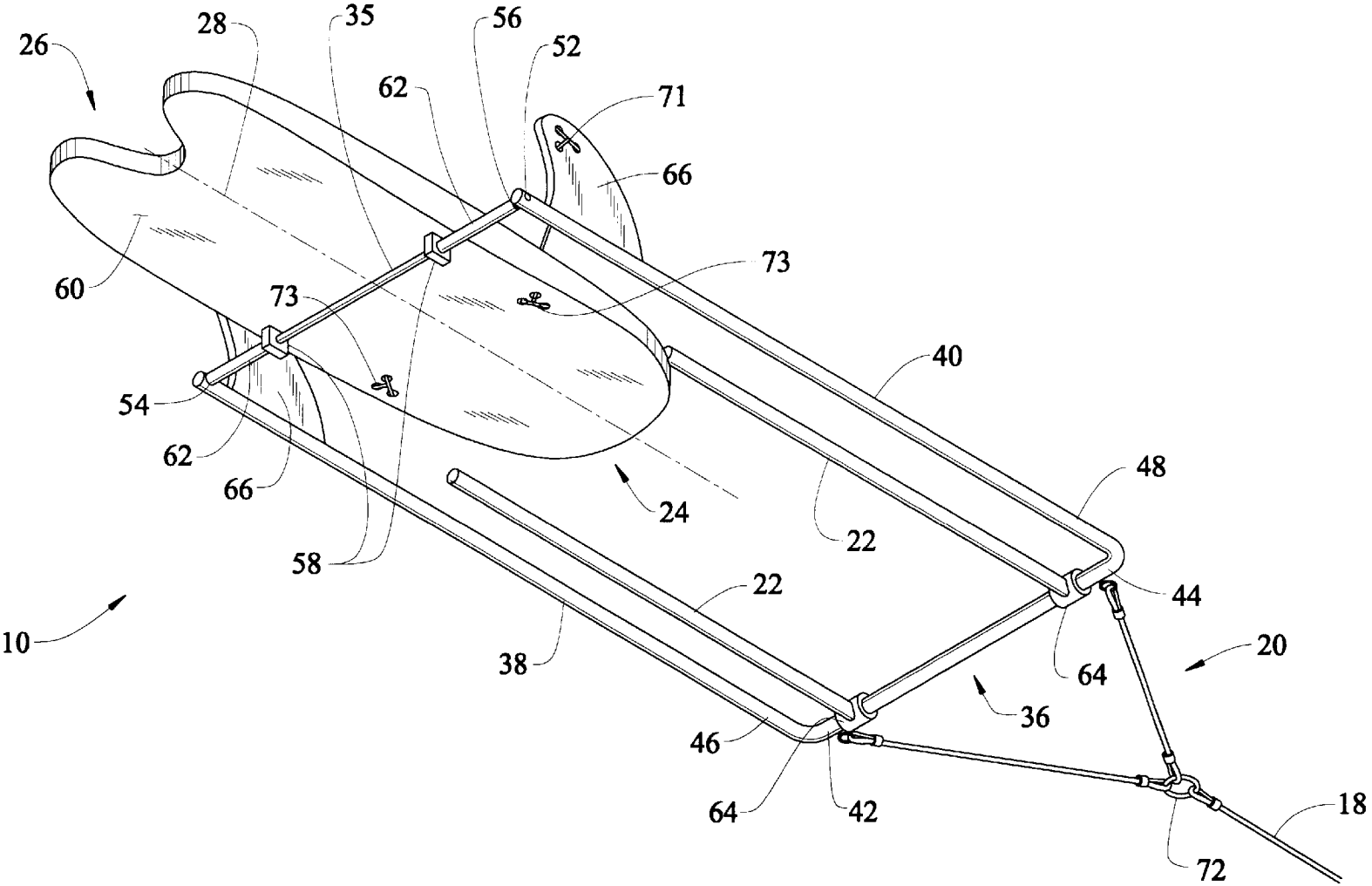
FIG. 3 is an bottom isometric view of the diver transportation assistance device shown in FIG. 1.

As show in FIG. 3, the linking frame 14 is a rigid, essentially-U-shaped unit. In a preferred embodiment, the linking frame 14 includes a cross beam 36 and a pair of side beams 38, 40 that extend, one each, from the cross beam ends 42, 44. Each side beam 38, 40 is characterized by a first end 46, 48 and an opposite second end 50, 52. The side beam first ends 46, 48 are each attached to corresponding cross beam ends 42, 44, and the side beam second ends 50, 52 are each attached to corresponding ends 54, 56 of the mounting axle 35. It is noted that the linking frame 14 may also be formed from a single contoured piece of material. The linking frame 14 is preferably made from wood, but may also be plastic or corrosion-resistant metal, if desired.

As mentioned above, the mounting axle 35 joins the support frame 12 to the linking frame 14. More particularly, and with reference to FIGS. 5 and 6, the mounting axle 35 allows the support platform 12 to pivot with respect to the linking frame 14. In a preferred embodiment, the mounting axle 35 spans between the second ends 50, 52 of the linking frame side beams 38, 40 and passes through attachment flanges 58 that extend from a distal surface 60 of the support platform 12. With continued reference to FIG. 6, the attachment flanges 58 cooperatively allow the support platform 12 to pivot about the mounting axle 35. The support platform 12 is centered between the linking frame side beams 38, 40 by spacer sleeves 62 disposed on the mounting axle 35; each spacer sleeve is sandwiched between one of the flanges 58 and a corresponding linking frame side beam. It is noted that the mounting axle may pass through the support platform 12, itself, thereby eliminating the need for use of attachment flanges 58; spacer sleeves 62 could still be used to center the support platform between the linking frame side beams 38, 40.

Figure 5:
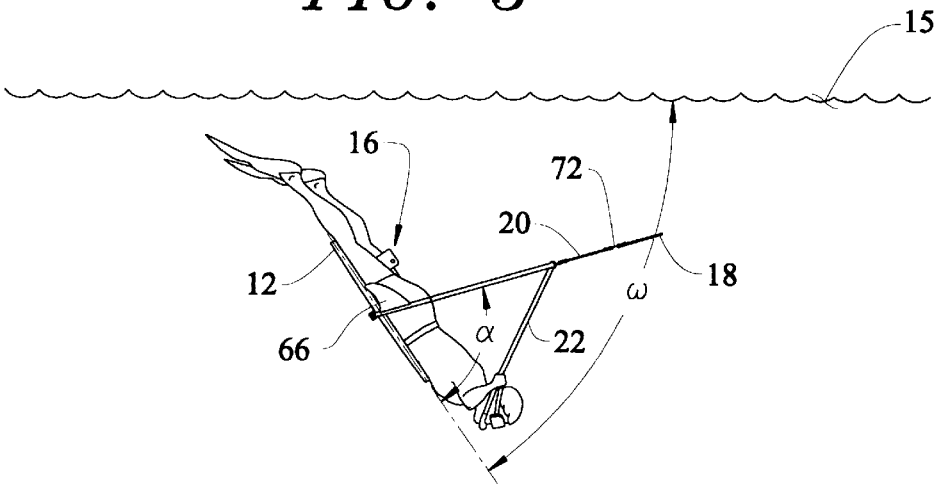
FIG. 5 is a pictorial view of the diver transportation assistance device shown in FIG. 1 in a descending orientation.
Figure 6:
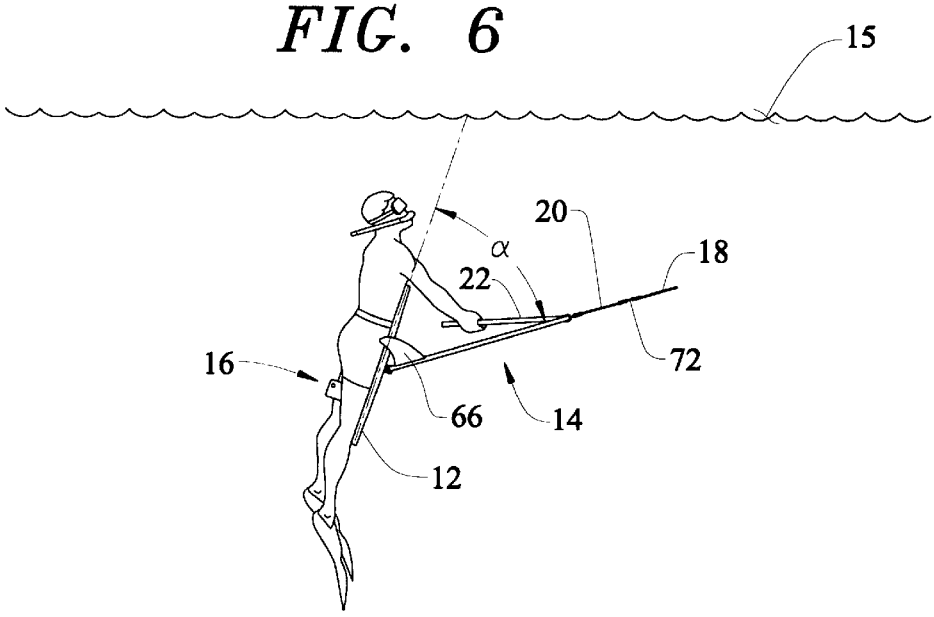
FIG. 6 is a pictorial view of the diver transportation assistance device shown in FIG. 1 in an ascending orientation.

With reference to FIGS. 2, 5, and 6, the articulation posts 22 are identical, and each post has an attachment end 64 pivotally connected to the linking frame cross beam 36. The articulation posts 22 provide leverage for a rider wishing to make the device 10 descend or ascend. By pushing on, or pulling against, the articulation posts 22, a rider may adjust the relative angle a between the support platform 12 and the plane of the linking frame 14. As the angle a between the support platform 12 and the plane of the linking frame 14 changes, the relative angle $\omega$ between the support platform 12 and the water surface 15 also changes, causing the support platform to ascend or descend accordingly. As the support platform front end 24 is aimed below the waterline 15, the device 10 will descend; aiming the support platform front end 24 above the waterline 15 will make the device ascend. The speed of ascent is a product of tow velocity and the absolute value of angle $\omega$, which is similar to the "angle of attack" often discussed with respect to airplane performance. Greater tow velocity and higher absolute values of $\omega$ bring about higher rates of ascent or descent.

As shown in FIG. 4, the articulation posts 22 need not be grasped at all times. For example, the articulation posts may be released during "level" travel, at a chosen depth. During constant-depth travel, the pivotal attachment of the articulation posts 22 beneficially allows the posts to trail behind the support frame 14 in an unobtrusive, yet easily-grasped, orientation. In keeping with the objectives of the present invention, this arrangement allows the support platform 12 to adopt a variety of orientations without needing to be axially aligned with the tow rope 18.

With additional reference to FIG. 2, the diver transportation assistance device 10 of the present invention includes a pair of guide fins 66 disposed, one each, on corresponding side beam second ends 50, 52. Guide fins 66 may be located at other positions, if desired, but placing the guide fins on the side beams 38, 40 facilitates inclusion of the automatic surface-skimming feature described below.

The device 10 includes biasing members 68 that cooperate with the guide fins 66 to urge the support platform 12 into a surface-skimming orientation. In a preferred embodiment, each biasing member 68 is a piece of elastic material, such as surgical tubing, that extends from one of the guide fins 66 to the support platform 12. Although a variety of materials may be used to form the biasing members 68, the spring constant of each biasing member 68 is preferably such that the support platform front end 24 will tend to point upward with respect to the water line 15. As a result, the present invention 10 will skim along the surface 15 of a body of water in which the device is being towed. With this arrangement, the biasing members 68 advantageously keep the device 10 from submerging unintentionally or diving uncontrollably when no rider is present. In a preferred embodiment, the support platform 12 forms an approximately forty-five-degree angle ω with respect to the water surface 15 in the surface-skimming orientation. The biasing members 68 may have adjustable first and second ends 71, 73 to allow slack adjustment within the device 10.

In keeping with the objectives of the invention, the device 10 also includes a tow rope attachment assembly 20 that facilitates joining the device to a tow rope 18 to be pulled by a tow vehicle 70. In a preferred embodiment, the tow rope attachment assembly 20 is a section of flexible material attached to the linking frame cross beam ends 44. The tow rope attachment assembly 20 includes a connection loop 72 that provides a preferred connection point for a tow rope 18, thereby reducing unwanted shifting between the attachment assembly and the tow rope.

Although the invention has been described in terms of a specific embodiment, it will be readily apparent to those skilled in this art that various modifications, rearrangements and substitutions can be made without departing from the spirit of the invention. The scope of the invention is defined by the claims appended hereto.

What is claimed is:

1. A diver's assistance device comprising:

a linking frame having a first side leg spaced apart from a second side leg, said linking frame being constructed and arranged for attachment to a tow vehicle;

a support platform adapted to underlie a rider, said platform being pivotally mounted between said first and second side legs; and a rider positioning construction extending from said support platform for maintaining a rider in a preferred location with respect to said support platform; and a control means for selectively pivoting said support platform with respect to said linking frame, said control means includes at least one articulation post mounted on said linking frame and arranged to facilitate relative pivoting of said support platform with respect to said linking platform;

whereby when said linking frame is attached to said tow vehicle, said device may be pulled within a body of water by said tow vehicle and a rider on said support platform may controllably steer said device within said body of water.

2. The diver's assistance device of claim 1, further including a biasing means for urging said support platform into a surface-skimming position.

3. The diver's assistance device of claim 1, further including guide fins extending from said support platform.

4. The diver's assistance device of claim 1, further including guide fins extending from said linking frame.

5. The diver's assistance device of claim 1, wherein said positioning construction includes a rigid spacing member extending from a rider-facing surface of said support platform, said spacing member being adapted to be engaged by a rider's legs.

6. The diver's assistance device of claim 5, wherein said positioning construction includes further includes at least one retention bar extending from said spacing member, said retention bar being adapted to maintain a rider's legs against said support surface of said support platform.

7. The diver's assistance device of claim 1 further including a tow line attachment means, said tow line attachment means being constructed and arranged to allow said support platform to freely and selectively pivot while under tow, for joining said linking frame to a tow rope adapted for attachment to said tow vehicle.

8. A diver's assistance device comprising:

a rigid linking frame having a first side leg spaced apart from a second side leg;

a support platform adapted to underlie a rider, said platform being pivotally mounted between said first and second side legs;

a rider positioning construction extending from said support platform for maintaining a rider in a preferred location with respect to said support platform;

a control means for selectively pivoting said support platform with respect to said linking frame;

a biasing means for urging said support platform into a surface-skimming position;

whereby when said linking frame is attached to said tow vehicle, said device may be pulled within a body of water by said tow vehicle and a rider on said support platform may controllably steer said device within said body of water.

9. The diver's assistance device of claim 8, wherein said control means includes at least one articulation post mounted on said linking frame, said at least one articulation post being constructed and arranged to facilitate relative pivoting of said support platform with respect to said linking platform.

10. The diver's assistance device of claim 9, wherein said at least one articulation post is pivotally mounted on said linking frame.

11. The diver's assistance device of claim 8, further including guide fins extending from said support platform.

12. The diver's assistance device of claim 8, further including guide fins extending from said linking frame.

13. The diver's assistance device of claim 8, wherein said positioning construction includes a rigid spacing member extending from a rider-facing surface of said support platform, said spacing member being adapted to be engaged by a rider's legs.

14. The diver's assistance device of claim 13, wherein said positioning construction includes further includes at least one retention bar extending from said spacing member, said retention bar being adapted to maintain a rider's legs against said support surface of said support platform.

15. A diver's assistance device comprising:

a rigid linking frame having a first side leg spaced apart from a second side leg;

a support platform adapted to underlie a rider, said platform being pivotally mounted between said first and second side legs;

a rider positioning construction extending from said support platform for maintaining a rider in a preferred location with respect to said support platform; said positioning construction including a rigid spacing member extending from a rider-facing surface of said support platform, and at least one retention bar extending from said spacing member; said spacing member being adapted to be engaged by a rider's legs; and said retention bar being adapted to maintain a rider's legs against said support surface of said support platform;

a control means for selectively pivoting said support platform with respect to said linking frame, said control means including at least one articulation post mounted on said linking frame, said at least one articulation post being constructed and arranged to facilitate relative pivoting of said support platform with respect to said linking platform; and a biasing means for urging said support platform into a surface-skimming position;

whereby when said linking frame is attached to said tow vehicle, said device may be pulled within a body of water by said tow vehicle and a rider on said support platform may controllably steer said device within said body of water.

16. The diver's assistance device of claim 15, wherein said at least one articulation post is pivotally mounted on said linking frame.

17. The diver's assistance device of claim 15, wherein said biasing means includes an elastic member adapted to guide said platform into said surface-skimming position, wherein said support platform forms an angle of about forty-five degrees with respect to a top surface of said body of water.

* * * * *